US008978816B2

(12) United States Patent
Slotznick

(10) Patent No.: US 8,978,816 B2
(45) Date of Patent: Mar. 17, 2015

(54) SOUND LIMITING ACOUSTIC SHELL USING A HANGING ACOUSTIC CANOPY

(71) Applicant: Benjamin Slotznick, Mt. Gretna, PA (US)

(72) Inventor: Benjamin Slotznick, Mt. Gretna, PA (US)

( * ) Notice: Subject to any disclaimer, the term of this patent is extended or adjusted under 35 U.S.C. 154(b) by 0 days.

(21) Appl. No.: 14/132,908

(22) Filed: Dec. 18, 2013

(65) Prior Publication Data

US 2014/0174845 A1 Jun. 26, 2014

Related U.S. Application Data

(60) Provisional application No. 61/740,153, filed on Dec. 20, 2012.

(51) Int. Cl.
*E04B 1/99* (2006.01)
*E04H 15/18* (2006.01)

(52) U.S. Cl.
CPC . *E04B 1/99* (2013.01); *E04H 15/18* (2013.01)
USPC ..... 181/30

(58) Field of Classification Search
CPC ..... E04B 1/99
USPC ..... 181/30
See application file for complete search history.

(56) References Cited

U.S. PATENT DOCUMENTS

| | | | | |
|---|---|---|---|---|
| 3,180,446 | A | 4/1965 | Wenger | |
| 3,217,366 | A | 11/1965 | Wenger | |
| 4,278,145 | A | 7/1981 | Eade et al. | |
| 4,942,938 | A * | 7/1990 | Wiegel | 181/30 |
| 4,947,832 | A | 8/1990 | Blitzer | |
| 5,069,011 | A | 12/1991 | Jenne | |
| 5,123,874 | A * | 6/1992 | White, III | 454/251 |
| 5,525,766 | A | 6/1996 | Atcheson et al. | |
| 5,646,378 | A * | 7/1997 | Van Haaff et al. | 181/30 |
| 5,651,405 | A | 7/1997 | Boeddeker et al. | |
| 6,085,861 | A | 7/2000 | Jines | |
| 7,600,608 | B2 | 10/2009 | Freiheit | |

(Continued)

FOREIGN PATENT DOCUMENTS

| | | | | |
|---|---|---|---|---|
| EP | 1030006 | A1 | 8/2000 | |
| JP | 2005146565 | A * | 6/2005 | E04H 15/20 |

OTHER PUBLICATIONS

News release: Auerbach + Associates Provides Theatre Systems and Seating Design to New Aspen Music Festival Tent, Apr. 17, 2001, printout from web page: http://www.auerbachconsultants.com/html/tpr14.html, 3 pages.

(Continued)

*Primary Examiner* — Forrest M Phillips
(74) *Attorney, Agent, or Firm* — Panitch Schwarze Belisari & Nadel LLP

(57) ABSTRACT

A temporary building structure is provided. The temporary building structure includes a top wall and an opposing floor surface covered by the top wall. The top wall and the floor surface define a first building area and a second building area. The first building area includes a floor surface configured to receive a sound source. The structure further includes a portable sound limiting acoustic shell including an acoustic canopy covering at least a portion of the first building area in which the sound source is positioned. The acoustic canopy is positioned proximate the floor surface, such that the acoustic canopy concentrates sound generated by the sound source within the first building area and isolates the generated sound from the second building area.

20 Claims, 15 Drawing Sheets

(56) References Cited

U.S. PATENT DOCUMENTS

| | | | | |
|---|---|---|---|---|
| 7,815,011 | B2 | 10/2010 | Holzman et al. | |
| 7,918,312 | B2 | 4/2011 | Carlson | |
| 8,091,605 | B1 | 1/2012 | Melhart | |
| 8,136,626 | B1 * | 3/2012 | Aliev | 181/198 |
| 8,430,199 | B2 * | 4/2013 | Stephenson et al. | 181/30 |
| 8,646,571 | B2 * | 2/2014 | Aliev | 181/198 |
| 2002/0100634 | A1 * | 8/2002 | Moskowitz | 181/30 |
| 2011/0024225 | A1 | 2/2011 | Stephenson et al. | |

OTHER PUBLICATIONS

"DPW Goes Hollywood (Bowl)." Los Angeles County Department of Public Works newsletter, original publication date: presumed to be Dec. 2003, printout from web page: http://ladpw.org/general/aitw/1203/DPW%20Goes%20Hollywood%20(Bowl).cfm, 1 page.

Zackery Belanger, "Acoustic Canopy produces clear sound, clear design." Fabric Architecture, Jan. 2008, printout from web page: http://fabricarchitecturemag.com/articles/0108_pr_acoustic.html, 3 pages.

Product brochure: Bandshells. Anchor Industries Inc., original posting date: 2011 (as per Internet Archive Wayback Machine), printout from web page: http://anchorinc.com/products/tents-fabric-structures/tension-tents/bandshells, 1 page.

* cited by examiner

SOUND LIMITING ACOUSTIC SHELL USING A HANGING ACOUSTIC CANOPY

CROSS-REFERENCE TO RELATED APPLICATIONS

This application claims priority to U.S. Provisional Patent Application No. 61/740,153, filed on Dec. 20, 2012, entitled "Sound limiting acoustic shell using a hanging acoustic canopy," the entire contents of which are incorporated by reference herein.

BACKGROUND OF THE INVENTION

This invention relates to the field of moveable and portable acoustic shells, as well as acoustic sound control. "Acoustic shells (or sound shells) are physical structures designed to capture sound produced in a performance area of a performance arts venue and to project the sound into an audience area of the venue," U.S. Pat. No. 7,815,011 (Holzman, et al.). "In addition to outward sound projection, an acoustical shell enables the individual performers to hear themselves and those around them so that they can make any necessary adjustments for intonation purposes without having to force their volume output in order to be heard," U.S. Pat. No. 5,525,766 (Atcheson et al.). Atcheson also teaches that "For many indoor performance settings, such as, for example, concert halls, auditorium or gymnasiums, the acoustics are less than ideal. In such indoor performance settings, an acoustical shell can help overcome the acoustical shortcomings of the performance area by keeping the sound from being lost to the sound-absorbing regions above the performance area, thereby allowing the performers to hear themselves better so that they can project a better blended sound to the audience."

In the prior art, the acoustic shell encloses portions of the performance area with a back wall, side walls, and a canopy (above the performance area). Such an acoustic shell acts in some ways like a megaphone or bull horn, with sound produced at the narrow end of the megaphone (the rear of the acoustic shell) and emitted towards the audience at the wider of the megaphone (the wider front of the shell). The most efficacious acoustic shells enclose all sides and top of the performance area, but portability concerns have often required some compromises in coverage. The canopy may extend beyond the performance area as well, U.S. Patent Application Publication No. 2011/0024225 (Stephenson, et al.).

In the prior art, portable acoustic shells have often consisted of individual, free-standing panels which can be set up individually behind musicians, or placed side-by-side in a line or semi-circle to form a shell. See, for example, U.S. Pat. No. 3,180,446 (Wenger); U.S. Pat. No. 6,085,861 (Jines); U.S. Pat. No. 5,651,405 (Boeddeker, et al.); U.S. Pat. No. 4,278,145 (Eade); U.S. Pat. No. 5,069,011 (Jenne); U.S. Pat. No. 7,918,312 (Carlson); and U.S. Pat. No. 8,091,605 (Melhart).

Portable acoustic shells have been composed of various materials, and have been structurally supported in various ways. The reflective properties of flexible sheet-like materials and fabrics have been used to construct partial shells (see Carlson) or entire band-shells (see bandshell by Anchor that looks like half of a tent: http://anchorinc.com/products/tents-fabric-structures/tension-tents/bandshells.

In all of the prior art, the audience area is conceived of as everything within line of sight of the performance area (essentially, the entire area in front of the musicians). Prior art acoustic shells may well double the sound volume everywhere in the audience area (see decibel mappings in Stephenson.)

Nonetheless, there are many events at which music is played, but many of the attendees have not come for the music and do not care to listen to the music. At the same time, it is desirable that all attendees can see each other to promote a feeling of inclusiveness. Examples include wedding receptions and college reunions, where some attendees want to dance, and others want to talk to each other—but nonetheless, all want to feel part of the same event. For this reason, they want to see each other and not be partitioned into separate spaces which would allow conventional acoustic partitions to acoustically isolate the separate spaces. Consequently, there is a need for a portable acoustic treatment which (a) provides aural feedback to musicians in the performance area, (b) projects sound onto only a portion of the total area within the line of sight of the musicians, and (c) limits the sound which reaches other portions of the venue.

This need is particularly acute in the case where such events are held under temporary tent-like structures (i.e., temporary building structures).

Large tents are used as temporary cover for out-of-doors social events such as college reunions and wedding receptions. These tents provide efficient cost-effective shelter from inclement weather (or threat of same), and often for large crowds. However, they have notoriously bad acoustics when one large portion of the people under the tent primarily want to talk to each other with little or no background music and another large portion want to primarily dance to music. (In other words, the talkers want little music, no music, or low volume music, while the dancers want much higher volume music.) Consider for example, a wedding reception or college reunion with a dance band.

In this context, bad acoustics means that when the music is playing, people sitting at tables throughout the tent (even far from the musicians) have extreme difficulty hearing conversation at their table.

The temporary and generally short-term nature of the structure exacerbates the problem for a number of reasons. The structure must be economical and practical for many different types of events, some with music and some without, so that high-cost or specialized acoustic treatments are prohibitive. In addition, the structure must be economical and practical for different uses of the space within the tent, such that for some events musicians are placed in one part of the tent (for example, a corner of the tent) and for some other events the musicians are placed in another part of the tent (for example, the middle of a side of the tent). This makes built-in acoustic baffling impractical. At the same time, because the structure is temporary and usually short term (often only for one day or a weekend), creating special acoustic fabrics for the event, or employing elaborate and time-consuming acoustic tuning of the space by specialists is impractical. In other words, although the part of the tent requiring acoustic isolation will vary from event to event, the acoustic treatment must also be simple to install by people who are not acoustic engineers or technicians.

The invention described herein solves this problem by acoustically isolating a portion of the tent without visually isolating that portion from the rest of the tent, and without creating physical barriers to trip people or impede crowd flow within the tent.

These large tents have been used for events such as wedding ceremonies or musical concerts, where most people in attendance are listening somewhat quietly and attentively to a relatively few celebrants or entertainers. Microphones, amplification, and audio speakers are deployed so that everyone throughout the tent will be able to hear the few people speaking or making music (the "performers").

Just as importantly, these tents are often used for events such as cocktail receptions, where there are no performers. Attendees may be standing up, talking to the person next to them. Alternatively, attendees may be sitting at tables, talking to the people at the table.

One problem is that at some events, for a part of the event everyone wants to hear the performers, while for another part of the event only some people want to hear the performers.

An example is a wedding held under such a tent, which consists of first a ceremony and then a reception. At the ceremony the guests are focused on the bride, groom, and officiant. At the reception with dance band, some want to dance, and others want to talk to each other. This makes it harder to position loud speakers and amplification systems to perform both tasks.

Just as importantly, percussive instruments such as drums cannot be effectively controlled by the sound technician in charge of amplification or mixing. This is because drums can fill the tent with loud volume sound even without amplification. In contrast, many amplified instruments such as an electric guitar, will make little or no sound without amplification. Importantly, the acoustics within one of these tents are sufficiently different from other common venues which such musicians often play. A musician playing drums in a large tent does not get accurate aural feedback to judge how loud he or she is playing in relation to the rest of the instruments, so will tend to play louder and louder. If the sound technician simply balances the amplified instruments (e.g. voice, guitar, wind instruments) with the percussive ones, the mixed sound (amplified and not amplified) will get louder and louder until it is too loud.

It also has to be noted, that these tents are acoustically "live", with sound bouncing off the tent roof (and tent sidewalls when in place) so that in a tent filled with people, even without music, it is often hard to hear people across a dinner table, or standing nearby.

Currently available acoustic barriers include acoustically designed wall-like partitions. These may be floor to ceiling or of varying heights. They may be solid, or somewhat transparent. They create acoustic separation by dividing the tent into separate acoustic spaces.

But they also separate the tent into distinct and separate social spaces, defeating one of the purposes of such get-togethers and impeding crowd flow under the tent. Also available are individual vertical acoustic baffles that could potentially be hung like banners from the tent roof structure, per the design of an acoustical engineer.

Canopies have been suspended to acoustically treat and condition permanent spaces, but are specially designed for each permanent space. These canopies may be of fabric or solid construction, but are often "tuned" for the space before, during and after construction, so that installation of the canopy from start to finish takes days, weeks, or months. Something that is not practical for a temporary structure for a short term event.

Note that tuning may involve fine adjustments to the placement or angling of the canopy, with acoustic testing after each adjustment. Tuning may involve adding or subtracting portions of the canopy or canopies, again with testing. Tuning may involve switching or treating the canopy material—fabric or otherwise. Tuning may involve design and manufacture of special fabrics to accomplish the particular acoustic treatment desired.

Just as importantly, these canopies are employed in concert venues, for performances. All of the attendees at the venue are listening to the performers. The canopies and other acoustic treatments may be used to condition sound by reflecting, absorbing, or transmitting it. The canopies and other acoustic treatments may be used to reflect some conditioned sound back to the performers, so that they can use the feedback to enhance their performance. However, the primary object of acoustic treatments at these venues, including canopies, is to make sure that everyone at the venue can hear the performance. For this reason, the canopies are often near the roof of the structure. But in any event, these canopies are not close to the performers, because that would contain or isolate the sound and prevent members of the audience from hearing the performance. As concert venues, they are not designed with a designated dance floor for the audience to dance.

BRIEF SUMMARY OF THE INVENTION

The invention is a structure of an acoustic canopy to concentrate sound in one part of the venue and substantially acoustically isolate that portion of the venue from the rest of the venue (so as to keep sound out of that other portion of the venue).

More specifically, the invention is a canopy made of flexible material similar to the tent fabric, which is suspended from the structure which holds up the tent. Preferably the canopy is suspended over both the musicians and the dance floor in front of them. (In an alternate embodiment, the canopy extends over a portion of the tent reserved for those who want to listen to the music, but not dance.) The bottom edges of the canopy can be walked under without stooping, but in most instances will be substantially closer to the dance floor than to the peak of the tent.

For some events, most of the tent floor is dirt or grass, while the portion of the floor reserved for dancing is a temporary wood structure on floor level or slightly raised above floor level to ensure a smooth surface for dancing (i.e., a platform).

More specifically, a sound limiting acoustic shell is described herein having an acoustic canopy that is suspended from tent structure of a temporary, portable tent. The acoustic canopy is preferably relatively close to the ground (low height). The acoustic canopy is arranged so as to isolate sound within a portion of the portable tent that is below the acoustic canopy (i.e., a first building area), as opposed to pushing sound out to the audience so that everyone in the performance venue can better hear the sound.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

DETAILED DESCRIPTION OF THE INVENTION

Certain terminology is used herein for convenience only and is not to be taken as a limitation on the present invention.

Figure 1:
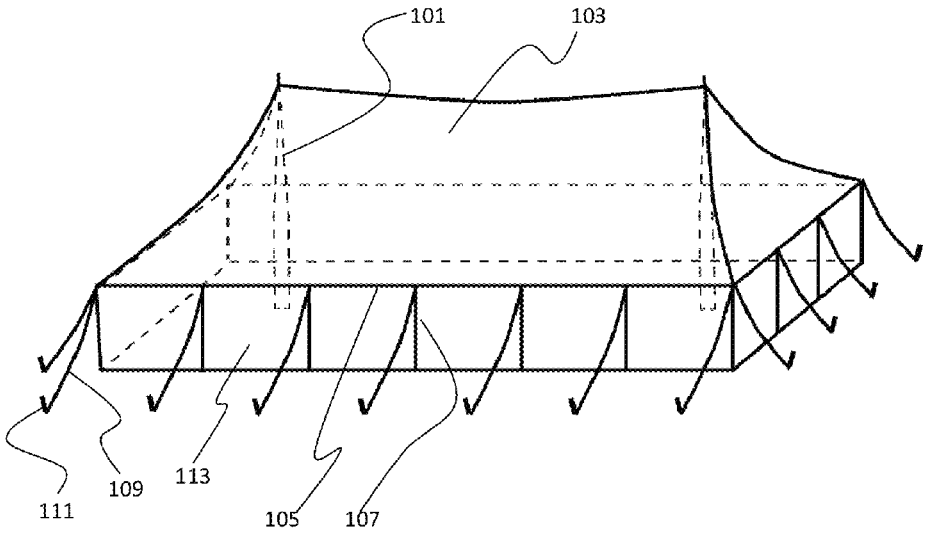
FIG. 1. An exterior view of tent without the invention.

FIG. 1 shows a typical tent used for outdoor events, as well known to those skilled in the art. The tent is shown with a typical rectangular footprint, though other footprints can be used, and the particular details of these figures are not intended to limit this disclosure or this invention.

This tent is a tension structure with the tent fabric, 103, held up by center poles, 101. Alternatively a tent-like structure can be built with the poles outside the tent footprint, or a tent-like fabric can be used to cover a skeletal structure like a geodesic dome or other frame-like structure. The advantage of tents without center-poles is an unobstructed floor area (i.e., floor surface). Modern tents can simulate the peak of pole-tents either by adding pole-like extensions to the structure of a frame tent, or by having poles suspended above the ground by steel cables, with their weight transferred to a tension structure. (These are often called "high-peak" tents.). The invention can be deployed or installed in any such outdoor structure. (Alternatively, the invention can be deployed in a permanent or indoor structure.) The fabric is stretched to a sidewall structure, consisting of vertical supporting columns (i.e., vertical supports), 107, and horizontal cross pieces (i.e., horizontal supports), 105, set on the columns. The fabric may have guys (cables or ropes) sewn into the fabric to enhance its structural integrity (not shown). Alternatively, the fabric may be stretched over such guys and fastened to them. The sidewall does not collapse because the weight of the tent roof fabric is supported by guys, 109, of rope or metal cable, which are attached to temporary or permanent stakes, 111, or tie downs in the ground. A fabric sidewall, 113, is shown hung on the structural sidewall. It may be solid or clear. In some installations, the fabric sidewall, 113, may be installed in a lowered position (as shown in FIG. 1) to keep out rain or cold. In other installations, the fabric sidewall is raised and tied to the cross pieces, 105, (as shown in 201 of FIG. 2) for greater ventilation. In alternative installations, the fabric sidewall may be omitted.

Figure 2:
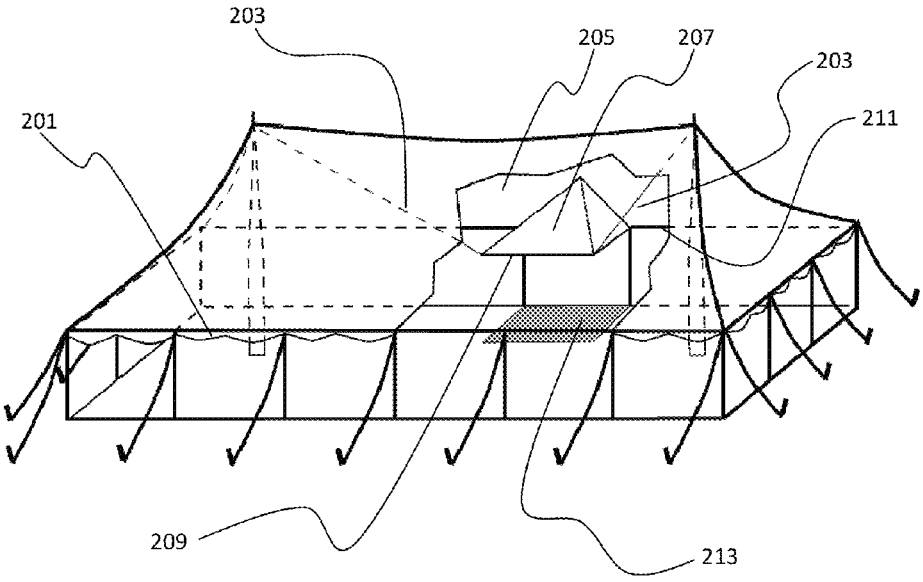
FIG. 2. An exterior view (with cut-away) of tent with a preferred embodiment of the invention.

FIG. 2 shows the same tent, but with a preferred embodiment of the invention installed. A cutaway of the tent fabric, 205, is shown to make it easier to picture the interior of the tent. In this illustration, a peaked canopy, 207 and 209, is installed against the "back" wall of the tent, furthest from the viewer (i.e., in a first building area). The canopy consists of fabric, 207. As shown in FIG. 2, the fabric 207 includes at least two panels joined at a peak or apex. In a preferred embodiment the perimeter of its base is rigid. For example the rigid perimeter may consist of structural metal pipes or lumber similar to the cross-ties shown as 105 in FIG. 1, and 211 in FIG. 2. The back edge of the canopy's rigid base is attached to and suspended from the back cross ties of the tent, 211. Alternatively, the canopy does not have a back rigid perimeter and is attached directly to (and suspended from) the tent cross ties, 211. The front rigid perimeter is shown as attached to the top of the tents center poles, by guys, 203, (cable or rope). Alternatively the front rigid perimeter of the canopy is suspended from other structural guy wires that support the tent roof (i.e., top wall) fabric. Alternately, for frame, high peak, clear-span, or pole-less tents, the guys are attached to the tent frame or other structural elements (not shown).

Alternative tent installations do not have sidewalls but are anchored to one or more permanent structures or buildings. Alternative tent installations do not have sidewalls on all sides. Some tents have the guys that support the tent roof fabric extend from the apex or ridge of the tent to the tie-downs in the ground, so that there are no structural sidewalls, though a side curtain wall may be suspended from the guys.

The portion of the floor of the tent under the canopy, 213, is preferably large enough for both the musicians and dancers (e.g., a plurality of individuals). This dance floor is a smooth structure at ground level or slightly raised above ground level. The purpose of the dance floor is to keep the dancers from tripping, and keep them safely segregated from others who are sitting or walking around. Sometimes a portion of the dance floor is raised as a stage for the musicians.

In an alternative embodiment the space under the canopy, 213, is filled with seats for attendees who want to hear the music (e.g., a plurality of individuals), while those who wish to talk to each other can sit elsewhere (i.e., a second building area). In another alternative embodiment, the space under the canopy, 213, includes both a dance floor (e.g., a platform) for those who want to dance to music, and seats for those who want to listen to music.

Figure 3:
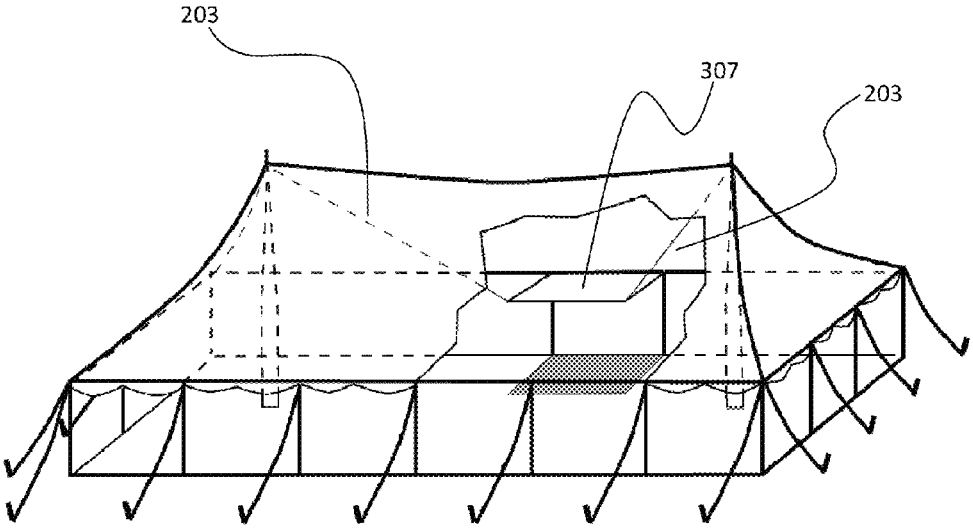
FIG. 3. An exterior view (with cut-away) of tent with an alternate embodiment of the invention.

FIG. 3 shows the same tent, but with an alternate embodiment of the invention installed. In this illustration the canopy is composed of a flat fabric, 307, fastened to the same rigid perimeter of the canopy as in FIG. 2 (see 209 in FIG. 2). As shown in FIG. 2, the flat fabric 307 is a single planar and flat panel.

FIG. 2 and FIG. 3 show the canopy base as square. Alternatively the base is rectangular, polygonal, circular, or without limitation some other shape. FIG. 2 shows the canopy as a pyramid. Alternatively, it is semi-spherical, dome-like, faceted, polyhedral, or some other shape that after installation is open only on the bottom.

The canopy in FIG. 2 is shown as a self-supporting pyramid, in which all edges are rigid or semi-rigid forming a structural skeleton of the canopy. In a preferred embodiment, the edges are lightweight structural members similar to those in the sidewalls, such as metal pipe. Alternatively, the structural members are bendable, such as plastic piping. The canopy fabric is attached to or stretched over the structural skeleton.

In an alternative embodiment the canopy has rigid edges around the perimeter of its base, but the remaining edges are not rigid, so that the canopy is not self-supporting. Instead the apex of the canopy is fastened to the tent roof fabric and is suspended from that point. Alternatively the apex of the canopy is fastened to a guy that also supports the tent roof fabric.

In an alternative embodiment, the perimeter of the base of the canopy is not rigid, but its shape is kept by guys that are fastened to various other parts of the tent and tent structure. In an alternative embodiment, the canopy itself is rigid. In an alternative embodiment the canopy is not fabric.

As taught above, the canopy is a stand-alone polyhedron or other three-dimensional object with an open bottom. One side of the canopy rests against the side of the tent roof. In an alternative embodiment, the one side of the canopy is formed solely by the tent roof, so that the canopy has to be attached to the tent roof to be enclosed on all sides other than the bottom.

In both FIG. 2 and FIG. 3, the bottom edge of the canopy is substantially closer to the ground (and surface of the dance floor) than it is to the peak of the roof of the tent. In one preferred embodiment, the bottom edge of the canopy is no higher than 10 feet above the dance floor.

In both FIG. 2 and FIG. 3, the canopy covers an area, 213, which adjoins a side of the tent and is in the middle of that side. In an alternate embodiment, and as is well known to those knowledgeable in the art, the canopy could just as easily be suspended so that the covered area is in a corner of the tent. Subsequent figures will detail the acoustic issue of these situations.

However, in an alternate embodiment, as is well known to those knowledgeable in the art, the canopy could just as easily be suspended so that the covered area is not adjacent to a side of the tent, but rather is in the middle of the tent. In another alternate embodiment, as is well known to those knowledgeable in the art, the canopy could just as easily be suspended so that the covered area is any particular portion of the tent floor. The suspended canopies in these alternate embodiments provide significant acoustic separation of the covered portions of the tent from the rest of the tent.

Figure 4:
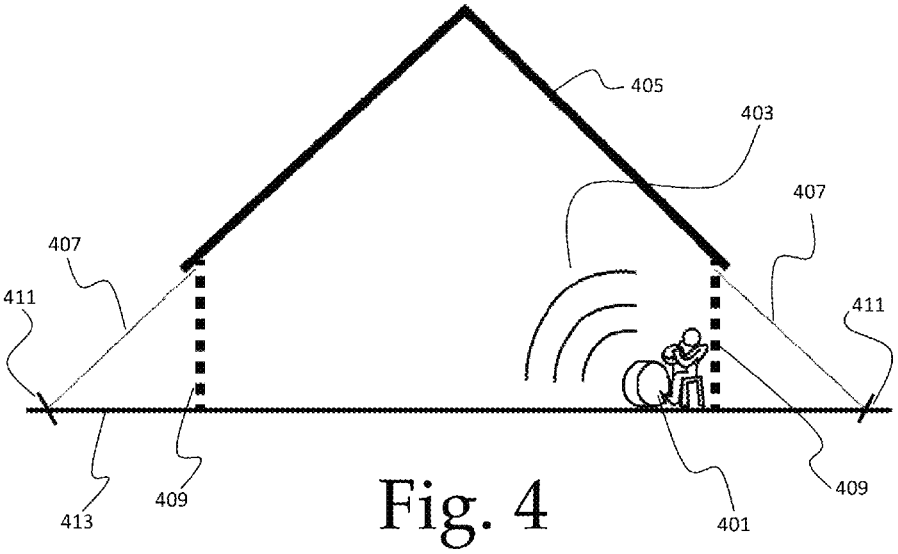
FIG. 4. A cross-section of a tent without the invention, showing propagation of percussive sound from drum-set.

FIG. 4 shows a cross section of the tent shown in FIG. 1. For ease of illustration, the tent roof fabric, 405, is shown forming straight lines, though in the field they may curve somewhat (see FIG. 1, FIG. 2, and FIG. 3). The cross-section is taken in between the center posts of FIG. 1, so the center posts are not shown. The roof fabric, 405, extends from the side walls, 409, to a peak. The sidewalls are shown as dashed, indicating that there may be no tent fabric over them. The tent sidewalls are held up under tension by guys, 407 (shown in FIG. 1 as 109), that are attached to tie-downs, 411 (shown in FIG. 1 as 111), in the ground, 413. As is well know by practitioners of the art, the sidewalls, 409, may be omitted if the guys, 407, run from the tie-downs, 411, to the tent peak, and are properly sized and spaced.

A sound source, 401, is shown. For illustrative purposes, the sound source is shown as a drummer, but is intended to represent other musicians as well. The sound waves, 403, propagate from the sound source, 401. If there is electronic sound amplification, and loud speakers are placed around the inside of the tent (not shown), the sound may propagate from the loud speakers as well.

For best performance of the invention, all loudspeakers used for the musicians (as opposed to those used for public address purposes) are located underneath the canopy.

Figure 5A:
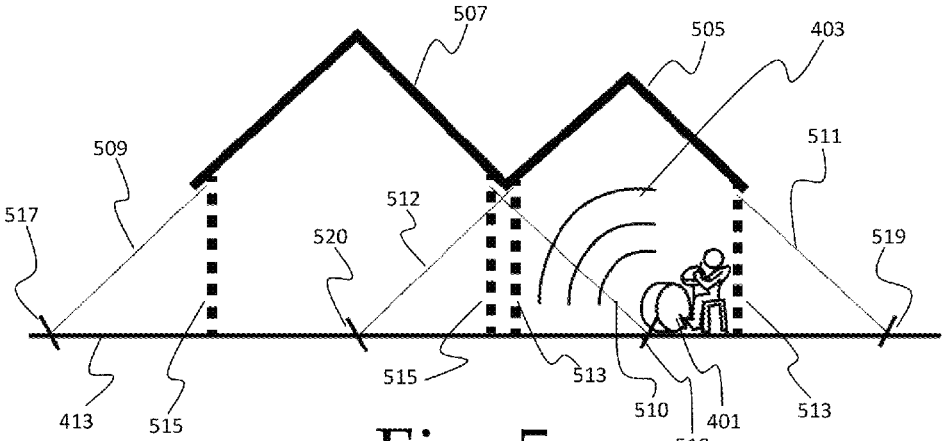
FIG. 5*a*. A cross-section of two adjacent tents (without the invention). One tent has a drum-set, the other does not.
Figure 5B:
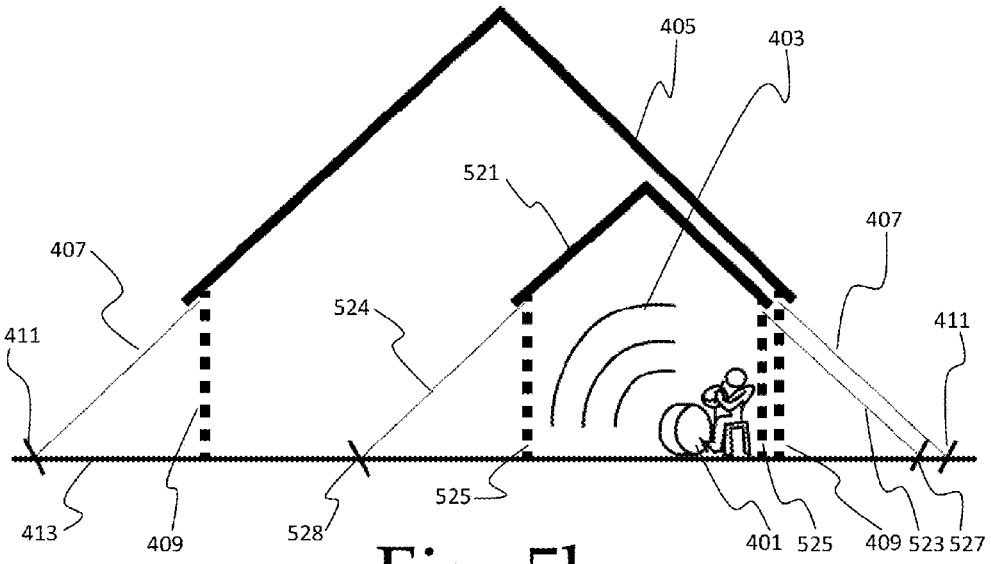
FIG. 5*b*. A cross-section of one tent erected within a larger tent, neither tent having the invention, but with the drum-set within the innermost tent.

As is well known to practitioners of the art, and anyone who has attended an event in such a tent, the volume of sound outside the tent is significantly less than inside the tent, even if the tent sidewalls have been raised. This will be discussed in further detail below. But it leads to a question of why sound volume should not be controlled by putting the musicians (perhaps with the dancers) in a separate, but attached tent. FIG. 5*a* and FIG. 5*b* show the problems with this approach.

In FIG. 5*a* the dance band is in one tent (perhaps with those who want to dance), with an adjacent tent reserved for those who want lowered sound volumes. The sound source, 401, produces sound, 403. The sound source is in a tent with fabric roof, 505, and sidewalls, 513, held by guys, 511 and 512, attached to tie-downs, 519 and 520, in the ground, 413. The second tent has a fabric roof, 507, and sidewalls, 515, held down by guys, 509 and 510, attached to tie-downs, 517 and 518, in the ground 413.

This arrangement will significantly isolate the music sound. However, some of the guys, 510 and 512, and tie-downs, 518 and 520, pose serious hazards for tripping musicians, dancers, and attendees in general. Having two tents increases erection costs and reduces the amount of space protected from inclement weather. In a restricted courtyard, this may make the main tent too small for the event.

An alternate way to employ two tents to isolate sound is to place one tent inside the other. This is shown in FIG. 5*b*, along with problems of that approach.

In FIG. 5*b* the dance band is in one tent (perhaps with those who want to dance), but that tent is constructed inside a larger tent. The sound source, 401, produces sound, 403. The sound source is in a tent with fabric roof, 521, and sidewalls, 525, held by guys, 523 and 524, attached to tie-downs, 527 and 528, in the ground, 413. The second tent has a fabric roof, 405, and sidewalls, 409, held down by guys, 407, attached to tie-downs, 411, in the ground 413.

This arrangement will significantly isolate the music sound. However, some of the guys, 524 and tie-downs, 528, pose serious hazards for tripping dancers walking on and off the dance floor as well as attendees in general. In addition, raising two tents increases erection costs.

Figure 7:
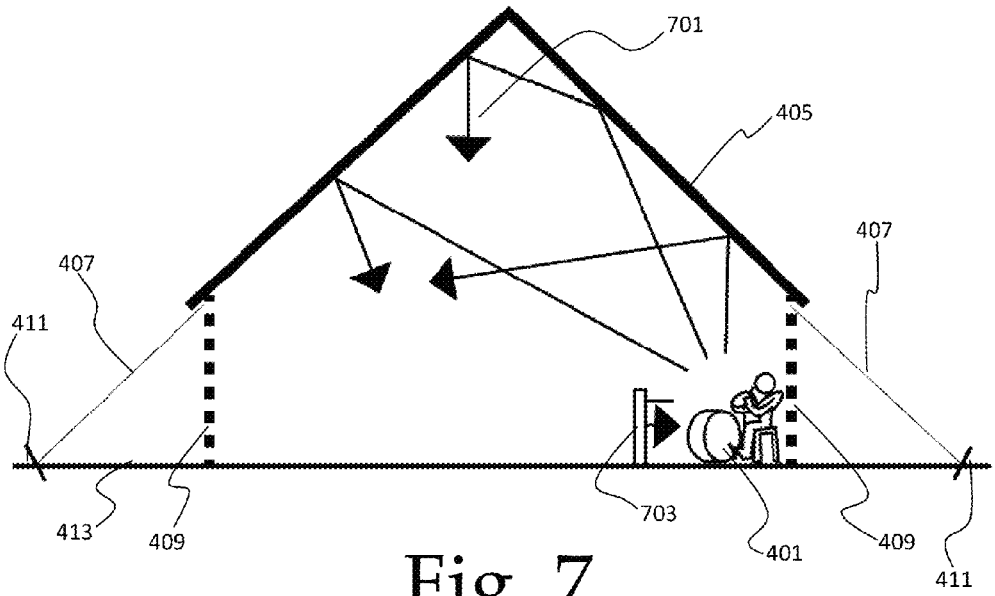
FIG. 7. This is the same as FIG. 6, but with the addition of a low drum sound shield placed in front of the drum-set.
Figure 8:
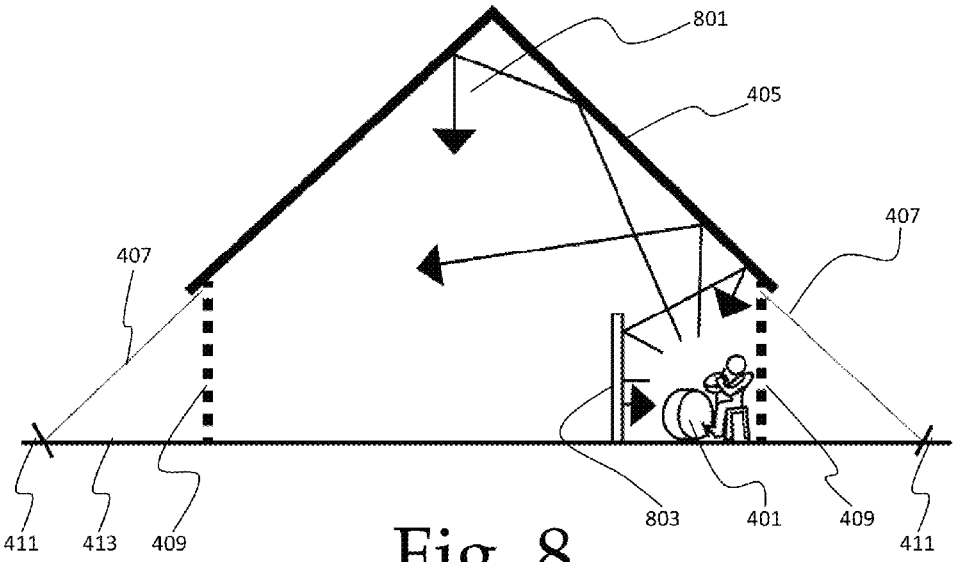
FIG. 8. This is the same as FIG. 6, but with the addition of a higher drum sound shield placed in front of the drum-set.
Figure 9:
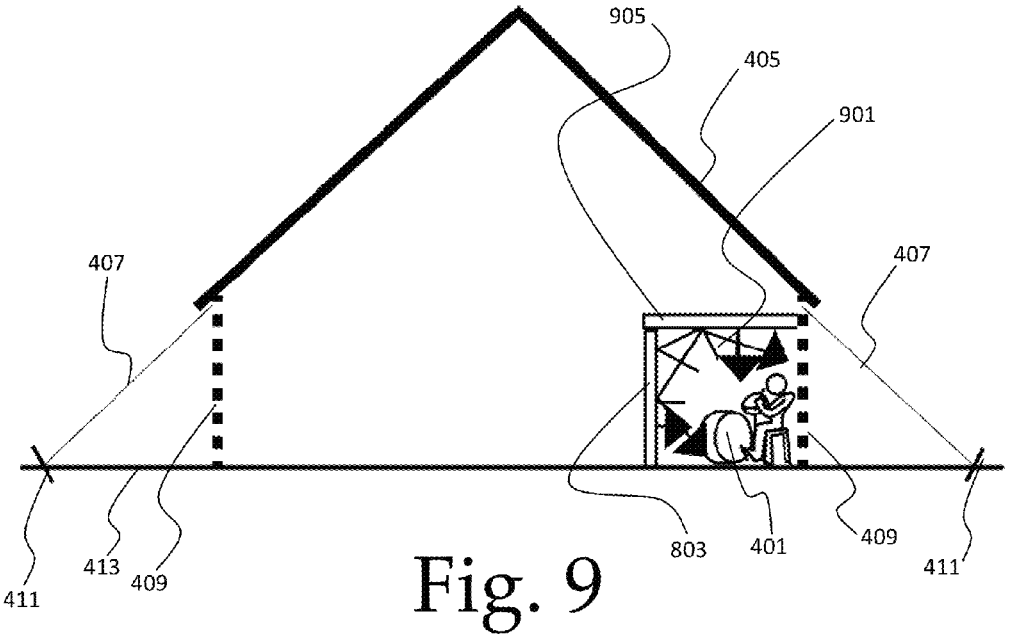
FIG. 9. This is the same as FIG. 7, but with the addition of a sound lid or sound isolating ceiling above the drum-set.

An alternative way to isolate the sound, well known to practitioners of the art, is to install acoustic sound boards around a musician—or between the musician and the audience. FIG. 7, FIG. 8, and FIG. 9 show the extent to which this approach works to isolate sound, and also highlight the cost and convenience of this method.

Figure 6:
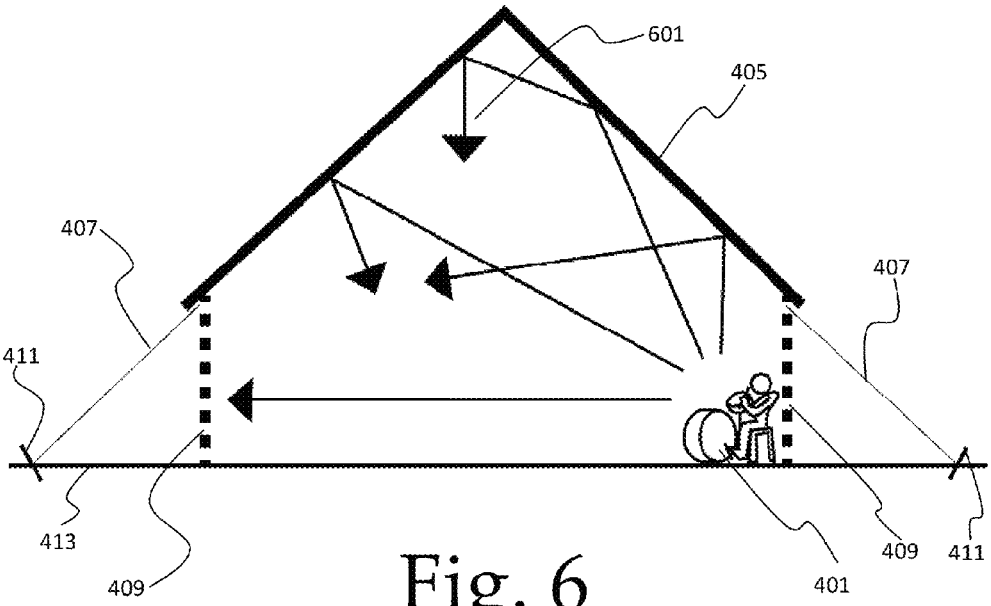
FIG. 6. A cross-section of a tent without the invention, similar to FIG. 4, but showing distinct sound paths within the tent.

Consider first FIG. 6. This figure shows the same cross-section of the tent as FIG. 4, with the same numbers for the same structural elements of the tent. However, instead of showing the sound as generally propagated, 403, as in FIG. 4, the figure shows some specific directions of sound propagation, 601. This helps one evaluate how portions of the sound are reflected or absorbed. Notice that in this figure, the sound does not reflect back to the musician, so he or she does not have a good sense of how loud he or she is playing.

Now consider FIG. 7. This figure is the same as FIG. 6, except that short acoustic sound panels, 703, are placed between the drummer and the audience. These are manufactured by several companies such as ClearSonic Mfg., Inc. (ClearSonic), Hudson, Ohio. They are 3, 4 or 5 feet tall. They can be placed in a semi-circle around the drummer, or can totally enclose the drummer. They may be free standing, or may attach to each other. As is well known to practitioners of the art of sound acoustics and studio recording, this will provide some acoustical isolation of the drummer or musician. Consider the sound paths, 701, with these acoustic panels in place. By reflecting some of the sound the sound back towards the musician, the musician has a better sense of how loud he or she is playing. This type of sound panel is readily available for rent or purchase.

Now consider FIG. 8. This figure is the same as FIG. 6, except that tall acoustic sound panels, 803, are placed between the drummer and the audience. These are manufactured by several companies such as ClearSonic. They are 6, 7, 8 or more feet tall. They can be placed in a semi-circle around the drummer, or can totally enclose the drummer. They may be free standing, or may attach to each other. Consider the sound paths, 801, with these tall acoustic panels in place. As is well known to practitioners of the art of sound acoustics and studio recording, this will provide greater acoustical isolation of the drummer or musician than the short panels shown in FIG. 7. By reflecting more of the sound back towards the musician, the musician has an even better sense of how loud he or she is playing. This type of sound panel is readily available for purchase, but less readily available for rent.

Notice that in FIG. 7 and FIG. 8, much of the sound produced by the musician is going up, bouncing off the tent roof and filling the tent. Whether or not the musician is amplified, this is sound that a sound technician cannot turn down or control.

Now consider FIG. 9. This figure is the same as FIG. 8, except that an acoustic sound panel, 905, (sometimes called a sound lid) is placed over the musician. The combination of tall sound panels, 803, and sound lid, 905, effectively create a sound isolation booth. Sound lids are manufactured by a several companies such as ClearSonic. As is well known to practitioners of the art of sound acoustics and studio recording, this will provide the greatest acoustical isolation of the drummer or musician. The sound isolation is much greater in FIG. 9 than in the arrangements shown in FIG. 7 and FIG. 8. Consider the sound paths, 901, with these acoustic panels in place. By reflecting more of the sound back towards the musician, the musician has the best sense of how loud he or she is playing. This type of sound panel is readily available for purchase, but not readily available for rent.

The need for sound isolation is not so much a problem with "quiet" instruments, such as a guitar, string bass, or clarinet. To some extent loud speakers can direct where sound is heard. However, percussive instruments such as a drum-set propagate a great deal of sound in all directions and everywhere, unless there is acoustic baffling, absorption or isolation.

In this situation, the sound booth will likely reduce the sound sufficiently that the drummer has to be amplified. However, then the drummer does not have to play loud. Volume is controlled by the sound technician.

Many small dance bands do not have such acoustic sound panels, and those that do are unlikely to want to transport them for a distant engagement. Most do not have tall sound panels and a sound lid. Many drummers who are not professional studio musicians do not like the enclosed feeling of an effective portable sound booth, feel that it inhibits the cohesive feeling and sound of the group, and refuse (or are reluctant) to use one.

In some ways a church poses the same acoustical problems as a big tent. Not surprisingly, when rock music is regularly played as part of church services, the church frequently uses such sound booths, or builds permanent sound isolating structures for the musicians.

The invention, as discussed in the text accompanying FIG. 2 and FIG. 3, teaches how these principles of sound isolation can be incorporated into a canopy suspended from the tent structure, rather than rely upon the musicians to provide same.

Figure 10:
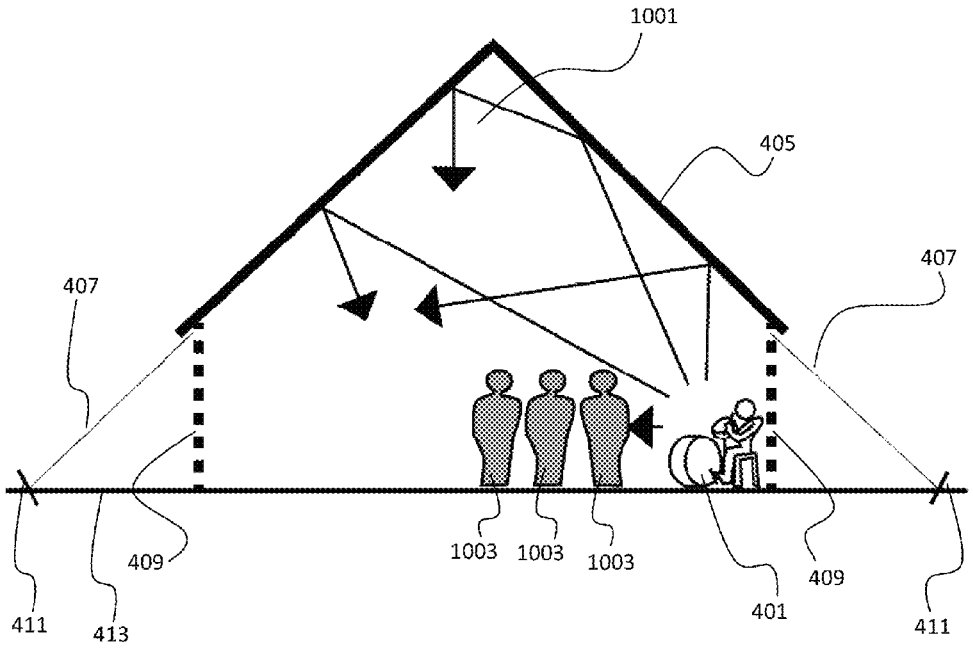
FIG. 10. This is the same as FIG. 6, but with the addition of people standing or dancing in front of the drum-set.

Before showing the extent to which the invention isolates sound, consider FIG. 10. This is the same as FIG. 4 (and FIG. 6), except it shows some people, 1003, who are attending the event. They may be dancing, or standing around the dance floor cheering the dancers. Consider the sound paths, 1001. Notice that the dancers absorb sound that would have been contained by the short acoustic sound panels, 703, in FIG. 7, but that the rest of the sound bounces off the tent and fills the room.

Figure 11:
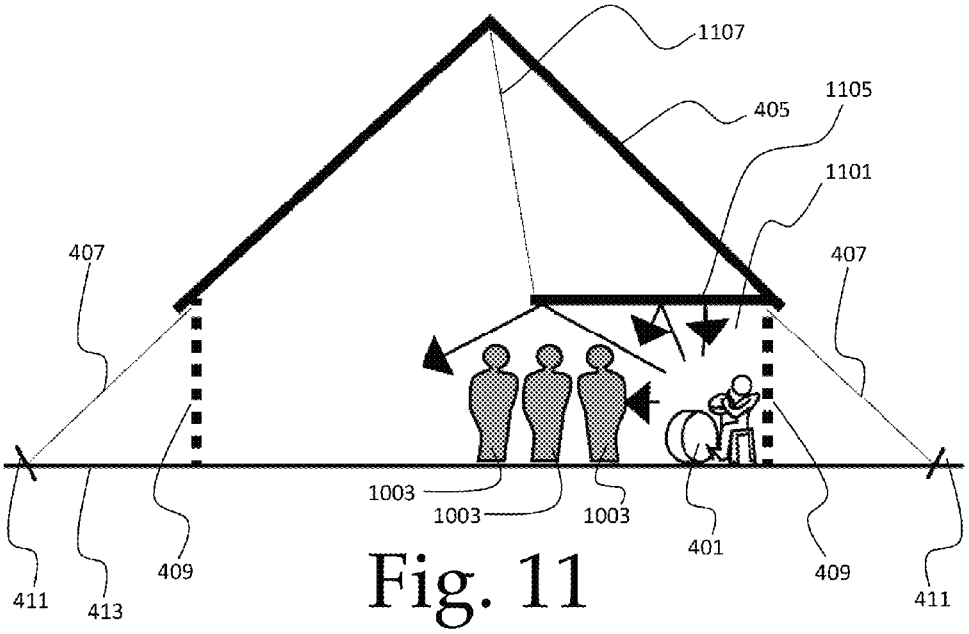
FIG. 11. This is the same as FIG. 10, but with a flat canopy over the drum-set and dance floor (an embodiment of the invention). The innermost part of the canopy is suspended from the top of the tent roof, while the outermost portion is attached to or suspended from the sidewall supports of the tent.

Consider now FIG. 11. This is a cross section of the tent shown in FIG. 3. The suspended canopy, 1105 in FIGS. 11 and 307 in FIG. 3, is suspended from the tent by guys 1107 in FIG. 11 and the guys 203 in FIG. 3.

FIG. 11 is also the same as FIG. 4 (and FIG. 6), except for the addition of people 1003, and of the suspended canopy, 1105 and its guys 1107. Notice that in FIG. 11, the bottom edge of the canopy is relatively close to the dance floor, especially when compared to the peak of the tent. In an alternate embodiment, the bottom edge of the canopy is not more than 10 feet from the ground.

For this embodiment of the invention (1105 and 1107), consider the sound paths, 1101. Some sound is directly absorbed by the dancer's bodies. Other sound is reflected from the canopy onto the dancers and absorbed by their bodies. (Notice that if there were not dancers, this sound might reflect off the dance floor into the greater tent space.) Some sound is reflected by the canopy back to the musician, giving the musician aural feed back. A relatively small portion of the sound goes over the heads of the dancers directly (or by reflection) into the greater tent space (e.g., a second building area).

The canopy, 1105, acts like a sound lid, 905 in FIG. 9. The dancers and onlookers, 1003, act like the full height acoustic sound panels, 803, of FIG. 8 and FIG. 9. The configuration of canopy and dancers provides a high degree of acoustic isolation without inconveniencing the musicians, or sound technicians who are often not equipped to provide such ad hoc acoustic treatments.

Figure 12:
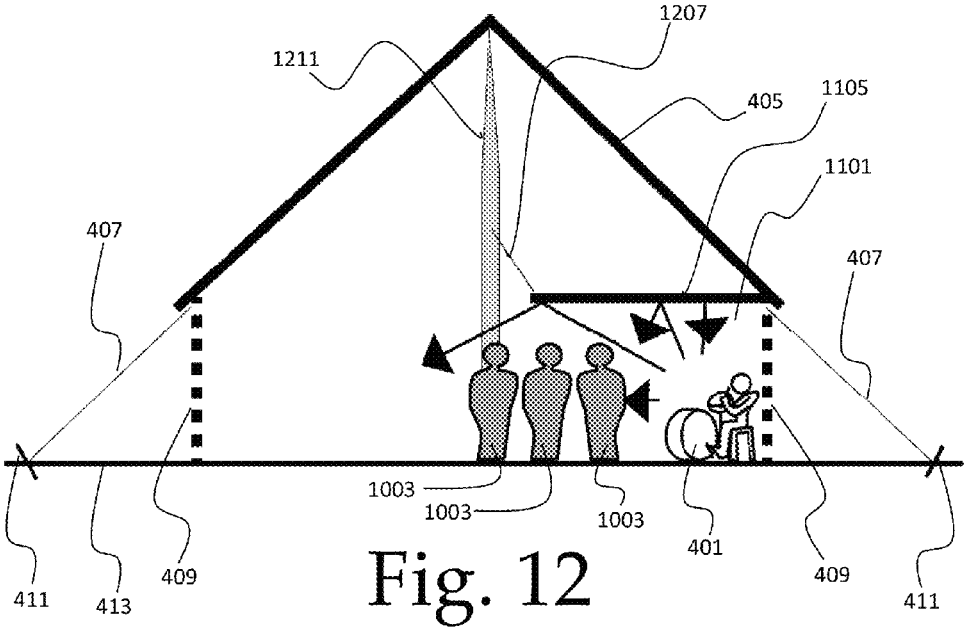
FIG. 12. This is the same as FIG. 11, but with the innermost part of the canopy suspended from the tent center poles.

FIG. 12 is the same as FIG. 11, except the front edge of the canopy, 1105, is not suspended from guys attached to the top of the tent, 1107, but from guys, 1207, attached to nearby center poles, 1211. Alternately, for frame, high peak, clear-span, or pole-less tents, the guys are attached to the tent frame or other structural elements (not shown). The embodiment of the invention shown in FIG. 12 provides the same degree of acoustic isolation and separation as the embodiment shown in FIG. 11. Alternative embodiments suspend the canopy from other structural elements of the tent.

Figure 13:
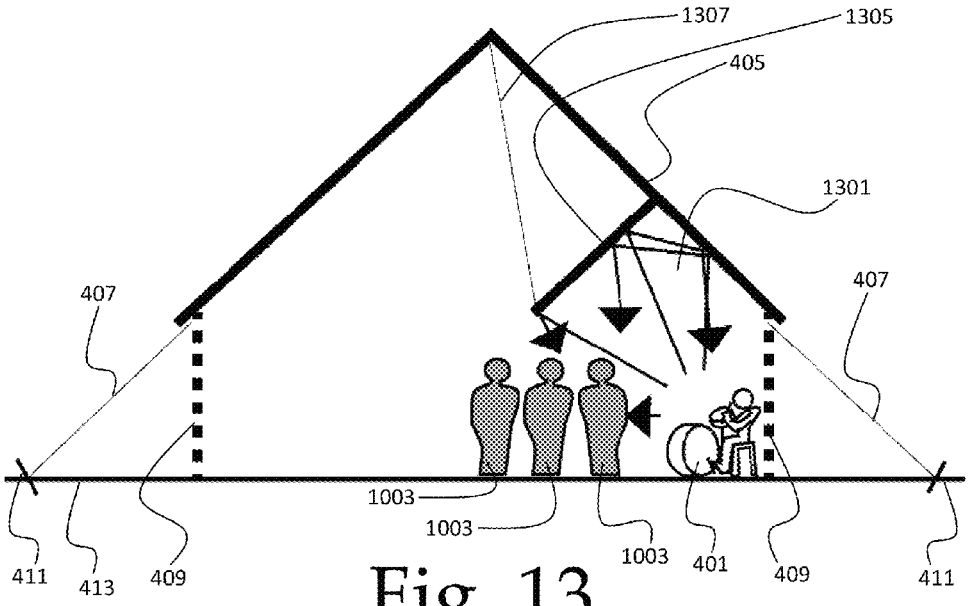
FIG. 13. This is the same as FIG. 10, but with a peaked canopy over the drum set and dance floor (another embodiment of the invention). The innermost part of the canopy is suspended from the top of the tent roof, while the outermost portion is attached to or suspended from the sidewall supports of the tent. The peaked part of the canopy is suspended from the tent roof, or guy wires which support the tent roof.

Consider now FIG. 13. This is a cross section of the tent shown in FIG. 2. The suspended canopy, 1305 in FIGS. 13 and 207 in FIG. 2, is suspended from the tent by guys 1307 in FIG. 11 and the guys 203 in FIG. 2. Alternately, for frame, high peak, clear-span, or pole-less tents, the guys are attached to the tent frame or other structural elements (not shown). Notice that in FIG. 13, the bottom edge of the canopy is relatively close to the dance floor, especially when compared to the peak of the tent. In an alternate embodiment, the bottom edge of the canopy is not more than 10 feet from the ground.

FIG. 13 shows that the canopy is in the same plane as the back part of the tent roof.

The acoustics are substantially the same whether the back of the canopy is attached to the tent roof, or just touches it. The acoustics are substantially the same whether the back part of the canopy is part of the tent roof or an independent structure. The acoustics are substantially the same whether the canopy is hard or soft, and whether the edges are maintained by tension or whether supported by rigid or semi-rigid edges.

FIG. 13 is also the same as FIG. 4 (and FIG. 6), except for the addition of people 1003, and of the suspended canopy, 1305 and its guys 1307.

For this embodiment of the invention (1305 and 1307), consider the sound paths, 1301. Some sound is directly absorbed by the dancer's bodies. Other sound is reflected from the canopy onto the dancers and absorbed by their bodies. (Notice that if there were not dancers, this might reflect off the dance floor into the greater space.) Some is reflected by the canopy back to the musician, giving the musician aural feed back. A relatively small portion of the sound goes over the heads of the dancers directly into the greater tent space, or reflected from the canopy into the greater tent space.

The canopy, 1305, acts like a sound lid, 905 in FIG. 9. The dancers and onlookers, 1003, act like the full height acoustic sound panels, 803, of FIG. 8 and FIG. 9. The configuration of canopy and dancers provides a high degree of acoustic isolation without inconveniencing the musicians, or sound technicians who are often not equipped to provide such acoustic treatments.

Figure 14:
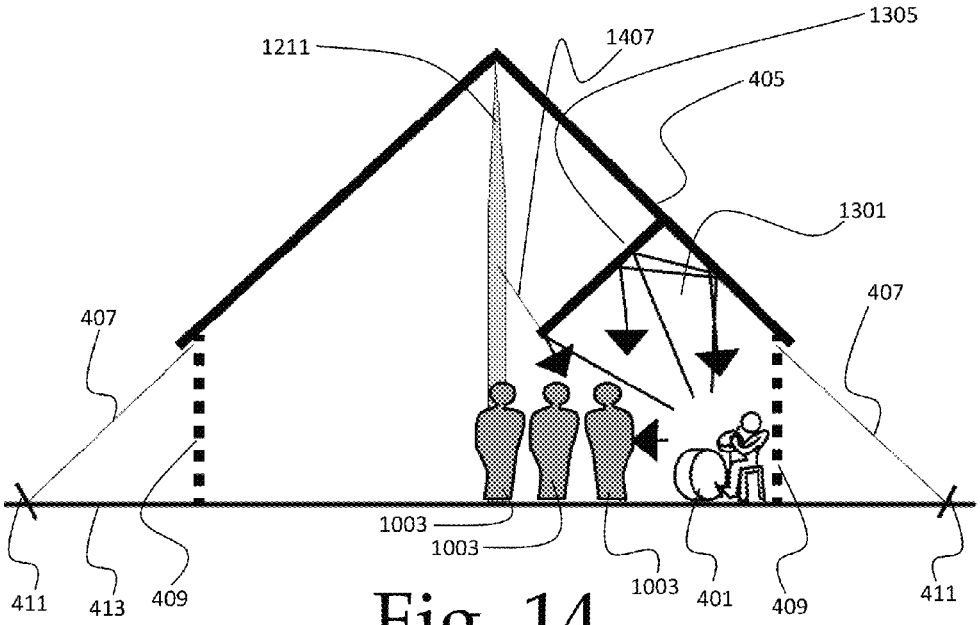
FIG. 14. The same as FIG. 13, but with the innermost part of the peaked canopy suspended from the tent center poles.

FIG. 14 is the same as FIG. 13, except that the canopy, 1305, is not suspended from guys attached to the top of the tent, 1307, but from guys, 1407, attached to a nearby center pole, 1211. Alternately, for frame, high peak, clear-span, or pole-less tents, the guys are attached to the tent frame or other structural elements (not shown). The embodiment of the invention shown in FIG. 14 provides the same degree of acoustic isolation and separation as the embodiment shown in FIG. 13. Alternative embodiments suspend the canopy from other structural elements of the tent.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

I claim:

1. A temporary building structure comprising:

a temporary building area comprising a top wall and an opposing floor surface covered by the top wall, the top wall and the floor surface defining a first building area and a second building area, the first building area having a floor surface configured to receive a sound source; and a portable sound limiting acoustic shell including an acoustic canopy covering at least a portion of the first building area which is configured to receive the sound source, the acoustic canopy being formed as a peaked canopy and being suspended within the temporary building area proximate the floor surface such that the acoustic canopy concentrates sound generated by the sound source within the first building area and isolates the generated sound from the second building area.

2. The temporary building structure of claim 1, wherein the temporary building structure is a temporary tent and wherein the top wall is formed as a peaked canopy.

3. The temporary building structure of claim 2, wherein the temporary tent is a tension structure, the top wall of the temporary tent being supported by a plurality of guys attached to stakes secured to a ground surface.

4. The temporary building structure of claim 3, wherein a portion of the acoustic canopy is secured to at least one guy of the plurality of guys.

5. The temporary building structure of claim 2, wherein a portion of the acoustic canopy is secured to the top wall of the temporary tent, such that the acoustic canopy is suspended therefrom.

6. The temporary building structure of claim 1, further comprising:

a plurality of vertical supports extending between the top wall and the floor surface; and a plurality of horizontal supports extending generally perpendicularly to the vertical supports, wherein a portion of the acoustic canopy is secured to at least one of the top wall, at least one of the plurality of vertical supports, and at least one of the horizontal supports.

7. The temporary building structure of claim 6, wherein the portion of the acoustic canopy secured to at least one of the top wall, at least one of the plurality of vertical supports, and at least one of the horizontal supports is semi-rigid or rigid.

8. The temporary building structure of claim 6, further comprising at least one sidewall supported by the plurality of vertical and horizontal supports.

9. The temporary building structure of claim 1, wherein the acoustic canopy is formed of at least two panels joined at an apex.

10. The temporary building structure of claim 1, wherein the acoustic canopy is made of a flexible material.

11. The temporary building structure of claim 10, wherein the acoustic canopy is made of a fabric material.

12. The temporary building structure of claim 1, wherein the acoustic canopy is positioned closer to the floor surface than to the top wall.

13. The temporary building structure of claim 12, wherein the acoustic canopy is positioned at a distance of 10 feet or less above the floor surface in the first building area.

14. The temporary building structure of claim 1, wherein the floor surface in the first building area is a platform configured to receive at least one of a plurality of seats and a plurality of individuals under the acoustic canopy, and wherein a first portion of the generated sound is reflected from the acoustic canopy onto the seats and/or individuals and is absorbed thereby and a second portion of the generated sound is reflected by the acoustic canopy back to the sound source.

15. The temporary building structure of claim 1, wherein the acoustic canopy is a self-supporting structure and each edge of the acoustic canopy is semi-rigid or rigid.

16. A portable sound limiting acoustic shell including an acoustic canopy made of a flexible fabric material and formed as a peaked canopy, the acoustic canopy being configured to be removably suspended from and within a temporary building structure proximate a floor surface thereof, such that the acoustic canopy concentrates sound generated under the acoustic canopy and isolates the generated sound from a remainder of the temporary building structure.

17. The portable sound limiting acoustic shell of claim 16, wherein the temporary building structure is a temporary tent.

18. A temporary building structure comprising:

a temporary building area comprising a top wall and an opposing floor surface covered by the top wall, the top wall and the floor surface defining a first building area and a second building area, the first building area having a floor surface configured to receive a sound source; and a portable sound limiting acoustic shell including an acoustic canopy covering at least a portion of the first building area which is configured to receive the sound source, the acoustic canopy being formed of a single generally planar and flat panel in a horizontal orientation generally parallel to the floor surface and being suspended within the temporary building area proximate the floor surface such that the acoustic canopy concentrates sound generated by the sound source within the first building area and isolates the generated sound from the second building area.

19. The temporary building structure of claim 18, wherein at least a portion of a perimeter of the single planar and flat panel is semi-rigid or rigid.

20. The temporary building structure of claim 19, wherein the acoustic canopy includes a base, at least a portion of a perimeter of the base being semi-rigid or rigid.

* * * * *